US006408740B1

(12) United States Patent
Holt et al.

(10) Patent No.: US 6,408,740 B1
(45) Date of Patent: Jun. 25, 2002

(54) THREE POSITION CYLINDER

(75) Inventors: Douglas J. Holt, Livonia; Robert C. Adams, Jr., Romeo, both of MI (US)

(73) Assignee: Welker Bearing Company, Troy, MI (US)

( * ) Notice: Subject to any disclaimer, the term of this patent is extended or adjusted under 35 U.S.C. 154(b) by 0 days.

(21) Appl. No.: 09/729,475

(22) Filed: Dec. 4, 2000

(51) Int. Cl.[7] ..... F15B 15/24; F01B 7/20

(52) U.S. Cl. ..... 92/13.1; 92/13.4; 92/13.6; 91/173

(58) Field of Search ..... 92/13.1, 13.4, 92/13.6, 52; 91/169, 173

(56) References Cited

U.S. PATENT DOCUMENTS 2,095,820 A * 10/1937 Lenz ..... 91/167 R
2,484,603 A * 10/1949 Audemar et al. ..... 416/47

* cited by examiner

*Primary Examiner*—F. Daniel Lopez
*Assistant Examiner*—Michael Leslie
(74) *Attorney, Agent, or Firm*—Young & Basile, P.C

(57) ABSTRACT

A three position cylinder assembly having an outer cylinder connected between two bases defining a cap end and a head end. A stationary tubular member is secured to the cap end of the outer cylinder at a port to provide fluid access into the outer cylinder. A first and second piston are disposed within the outer cylinder and have reciprocal movement therein. Each piston is connected to a rod which is concentric with the tubular member. The head end has an aperture for receiving the rods for extension beyond the outer cylinder. The tubular member has a stop at an end and the first piston and rod have reciprocal movement along the tubular member, wherein the stop defines a stable mid-position of the cylinder assembly. The second piston and rod have reciprocal movement along the first rod between the first piston and head end, wherein the head end defines a stable fully extended position of the cylinder assembly.

15 Claims, 3 Drawing Sheets

| | SOL 94 | SOL82 | SOL 84 |
|---|---|---|---|
| EXTEND TO MID POS | + | − | − |
| EXTEND FULLY | + | + | − |
| RETRACT TO MID POS | + | − | + |
| RETRACT FULLY | − | − | + |
| NEUTRAL | − | − | − |

THREE POSITION CYLINDER

FIELD OF THE INVENTION

The present invention relates to a cylinder having two piston and rod assemblies and more particularly, a cylinder having three stable positions of the piston and rod assemblies including a fully retracted position, a fully extended position, and a predetermined mid-position.

BACKGROUND OF THE INVENTION

Pneumatic or hydraulic cylinders are known to be used to move objects with the movement of the associated piston and rod assembly. In most instances, it is desirable to move the object from the position where the piston and rod assembly is fully retracted to the position where the piston and rod assembly is fully extended. In addition, it is sometimes necessary to move the object to a position extension that corresponds with a predetermined mid-position of the piston and rod assembly. In the prior art, to accomplish this, it is necessary to provide a tandem cylinder such that a cap end cylinder has a stroke corresponding to the mid-position extension and the rod end cylinder has a stroke corresponding to the cylinder's full stroke length. The cap end cylinder then moves the piston and rod assembly to the first mid-point extension before stopping. Pressure applied to the cap end of the rod end cylinder moves the piston and rod assembly the remaining length extension to provide the final displacement. As a result, a tandem cylinder will have a length equal to the length of a cylinder of the full stroke plus the length of a cylinder of the mid-position stroke. This configuration can be a disadvantage where available property around the cylinder and the moveable object is at a premium.

SUMMARY OF THE INVENTION

It is the intent of the present invention to address the aforementioned disadvantage. According to the invention, it is desired to provide a three position cylinder with two piston and rod assemblies, wherein the cylinder housing has a length that is less than the total combined stroke lengths of the piston and rod assemblies.

In one aspect of the invention, a three position cylinder assembly is provided for movement between a fully retracted position to a mid-position extension and to a fully extended position. The cylinder assembly has an outer cylinder housing connected between two bases, the first base defines a cap end of the cylinder and the second base defines the head end of the cylinder. The three position cylinder assembly also includes a first piston connected to a first rod and a second piston connected to a second rod wherein both the first and second pistons are disposed within the outer cylinder. The second base has an aperture therethrough to permit extension of the rods beyond the outer cylinder housing. A bumper disposed in the outer cylinder defines a stop means for one of the pistons. The stop means further defines the mid-position extension of the cylinder assembly.

In another aspect of the invention, the three position cylinder assembly further includes a stationary tubular member connected to one end of the outer cylinder and extending a predetermined length within the outer cylinder, and wherein the first piston has reciprocal movement along the outside surface of the tubular member. The tubular member has a stop means on the free end.

In another aspect of the invention, the first rod has an open end distal from the first piston for providing a fluid passageway therethrough and an expanded collar connected to the first piston. The second piston has reciprocal movement along the first rod.

In yet another aspect of the invention, the first piston forms a first fluid chamber on one side and defines a wall for a second fluid chamber on the other side of the first piston. The second piston forms a third fluid chamber on one side of the second piston and defines another wall for the second fluid chamber on the other side of the second piston.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
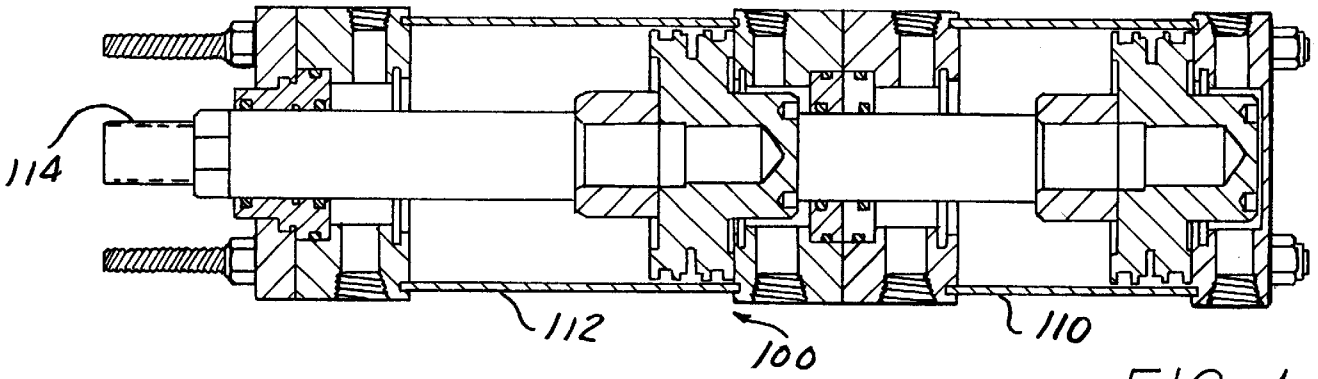
FIG. 1 PRIOR ART
FIG. 1 is a side elevational view of a three position cylinder of the prior art.

FIG. 1 shows a typical cylinder of the prior art. The three position cylinder 100 of the prior art generally includes a tandem cylinder having a cap end cylinder 110 and a rod end cylinder 112. The cap end cylinder 110 has a stroke to an intermediate position and the rod end cylinder 112 has a stroke to the fully extended position. The cap end cylinder 110 moves the rod 114 to the first intermediate position before stopping. The addition of pressure to the cap end of the rod end cylinder 112 moves the rod 114 to the fully extended position to provide the final end stop displacement. The cylinder 100 is therefore required to have a length at least the total length of the rod end cylinder 112 plus the length of the cap end cylinder 110.

Figure 2:
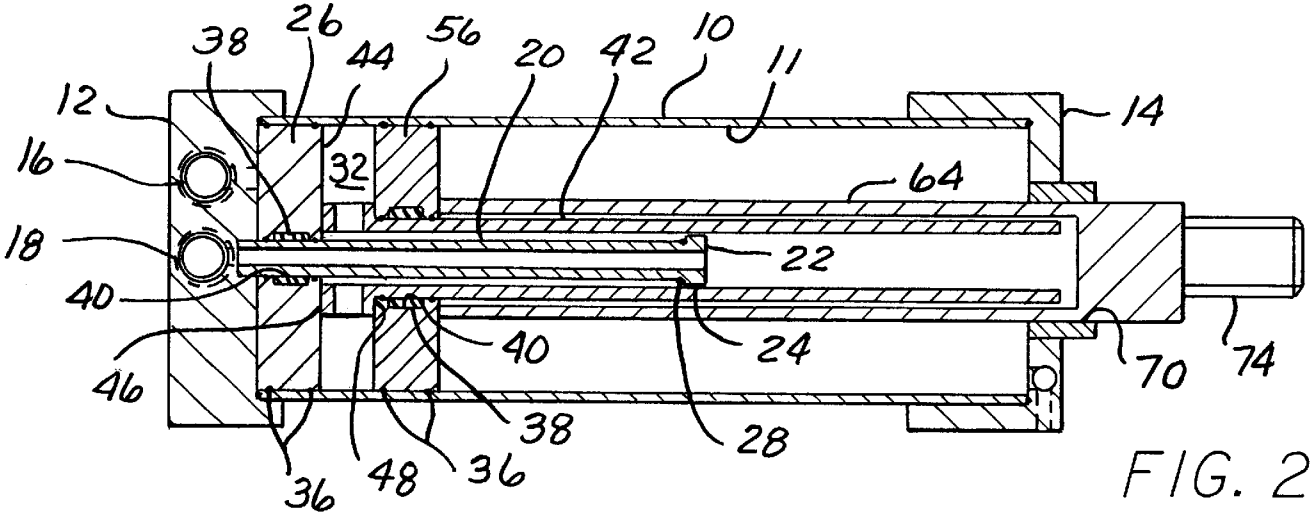
FIG. 2 is a side elevational view of a three position cylinder assembly according to the present invention shown in a fully retracted position.
Figure 3:
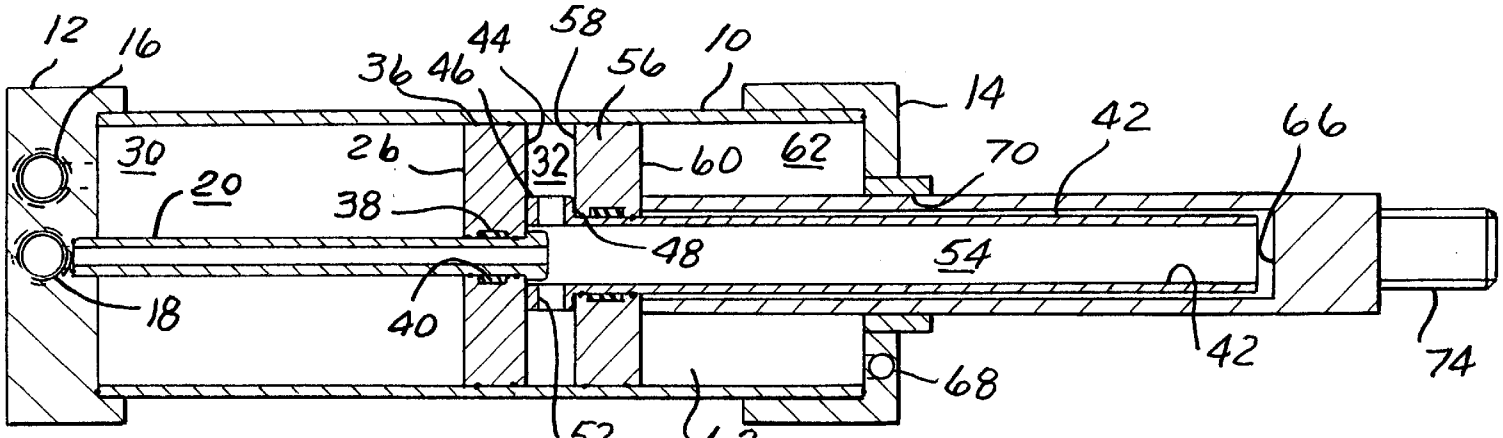
FIG. 3 is a side elevational view of the three position cylinder assembly of FIG. 2 extended to a mid-position extension.
Figure 4:
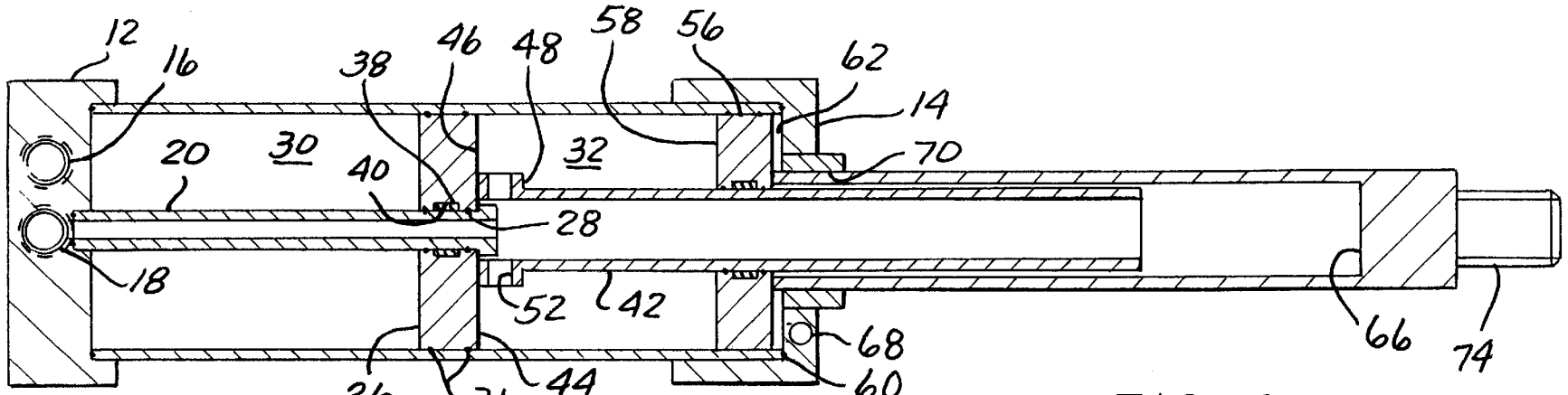
FIG. 4 is a side elevational view of the three position cylinder assembly of FIG. 2 shown in a fully expanded position.

Referring now to FIGS. 2–4, a three position cylinder assembly embodying the present invention is shown. The assembly includes the elongated outer cylinder designated by the numeral 10 forming a circular bore 11 therein. The outer cylinder 10 has a walled cap end 12 and a partially opened walled head end 14. Ports 16 and 18 are provided in the walled cap end 12 for fluid access to the interior of outer cylinder 10. Port 18 is centrally located in the walled cap end 12. A tubular member 20 is sealingly connected to the port 18 and extends into the interior of the outer cylinder 10. The tubular member 20 is opened at each end to provide a fluid conduit from port 18 into the interior of the outer cylinder 10. The length of the tubular member 20 is predetermined to provide the desired mid-position extension. A mid-position extension stop means 24 is provided on the tubular member 20 at the end 22 distal from the port 18. The mid-position extension stop means 24 may include an expansion of the tubular member 20 such as a flange at end 22, or a boss securely attached to the exterior of the tubular member 20 at end 22.

A moveable first piston 26 is slidably received on the tubular member 20. The first piston 26 is moveable between the walled cap end 12 of the outer cylinder 10 and the mid-position extension stop means 24 of the tubular member 20. It is preferred to have a cushioned bumper 28 located inwardly of the mid-position extension stop means 24 on the tubular member 20 to cushion the end stroke of piston 26.

The first piston 26 divides the interior of the outer cylinder 10 into a first and second chambers, 30 and 32, respectively. To prevent fluid movement between the first and second chambers, the first piston 26 will preferably have sealing elements 36, 38 on the exterior surface of the piston or in circumferential grooves 40 formed in piston 26. A rod 42 is securely attached to an outside face 44 of first piston 26, i.e., the face 44 exposed to the second chamber 32. The first rod 42 is a hollow cylindrical member concentric with tubular member 20. The first rod 42, has an open through bore 54 providing another passageway for pressurized fluid entering port 18. The first rod 42 has a first end 46, connected to the face 44 of the first piston 26. The first end 46 of rod 42 includes a mid-position retraction stop means 48. In the preferred embodiment, the mid-position retraction second stop means includes an external collar or shoulder 48 along the outside wall of rod 42. An open port 52 is provided through the shoulder 48 of the first rod 42. The port 52 provides fluid access between the second chamber 32 and the interior of the first rod 42. The chamber formed by the interior of rod and the interior of the tubular member 20 is herein referred to as the third chamber 54.

A second piston 56 is slidably seated on the first rod 42. Piston 56 moves within the outer cylinder 10 axially along the first rod of 42 and between the head end 14 of the outer cylinder 10 and the shoulder 48 of the first rod 42. The second piston 56 is also disposed between two chambers within the outer cylinder 10. To also prevent fluid movement between the second and fourth chambers, the second piston 56 will preferably have sealing elements 36, 38 on the exterior surface of the piston 56 or in circumferential grooves 40 formed in piston 56. An inside face 58 of the second piston 56 forms an end wall to the second chamber 32. The outside face 60 of the second piston 56 forms an end wall to a fourth chamber 62. A second rod 64, is securely attached to the outside face 60 of the second piston 56. The second piston rod 64 is concentric with the first piston rod 42 and the tubular member 20. The second piston rod 64 has a closed end 66 distal from the second piston 56. The closed end 66 of rod 64 encapsulates the third chamber 54.

The partially opened rod end 14 has a through aperture 70 for slidable disposition of rods 42 and 64 beyond the outer cylinder 10. A port 68 is located in the rod end 14 and adjacent to aperture 70 to provide an access for pressurized fluid into the fourth chamber 62. The ports 16, 18 and 68 are selectively opened and closed to move the first and second pistons 26 and 56 and their associated rods 42, 64 respectively. A device can be connected to the exposed end 74 of the second rod 64 to provide reciprocal motion of the device by the three position cylinder.

Figures 5, 6:
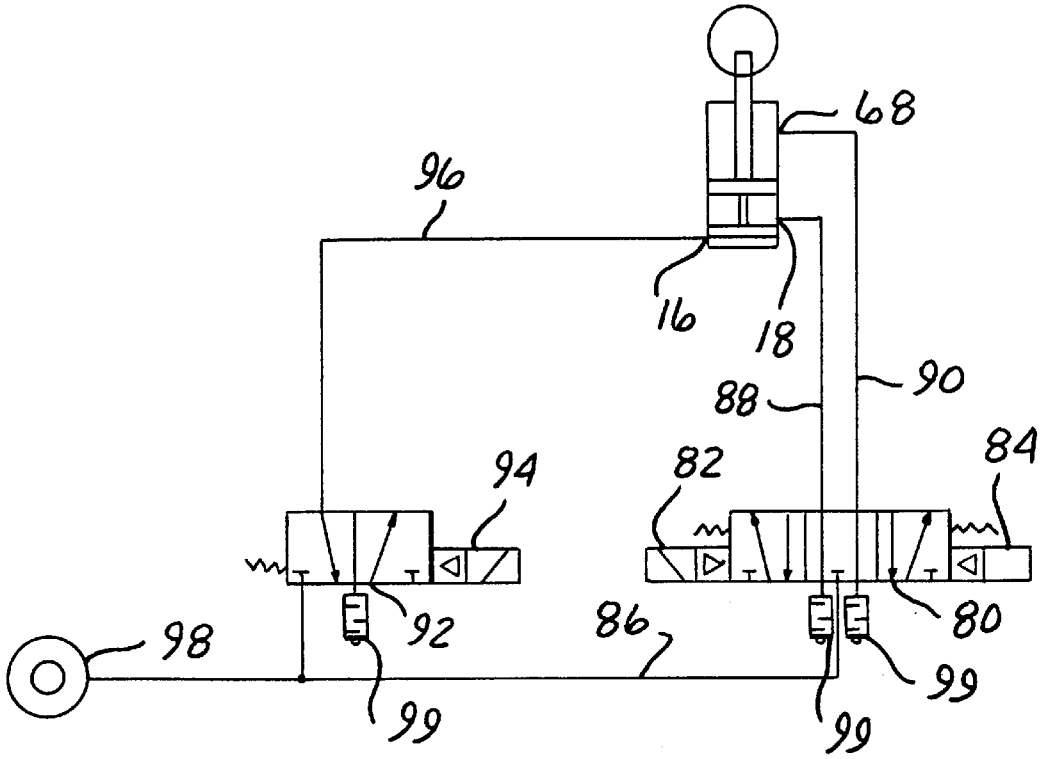
FIG. 5 is a schematic diagram of a drive circuit for the three position cylinder assembly.
FIG. 6 is a table setting forth the program controlling actuation of the various valve operating solenoids of the drive circuit of FIG. 5.

In operation, pressurized fluid is routed to the individual ports via solenoids. FIG. 5 shows a schematic of the drive system for the three position cylinder assembly. In FIG. 5 there is shown a proportional directional control valve 80 having solenoids 82 and 84 which operate the proportional control valve 80 in a conventional manner. Specifically, the proportional control valve 80 is adapted to variably connect conduits 86 selectively to conduits 88 and 90 or to the position as shown in FIG. 5, wherein the proportional valve 80 is closed and center to prevent communication between the conduits 86 with conduits 88 or 90. Conduit 88 communicates with port 18, and conduit 90 communicates with port 68. Valve 92 having solenoid 94 allows conduit 86 to connect to conduit 96 which communicates to port 16. Conduit 86 is connected to a source of pressurized fluid 98.

The neutral function as indicated in FIG. 5 shows that all of the valve operating solenoids 82, 84, 94 are in their normal de-energized state. The negative sign in the table of FIG. 6 indicates a de-energized state of the solenoid. A positive sign in the table indicates an energized state of the solenoid.

To cause the three position cylinder to be extended to its mid-position as shown in FIG. 3, solenoid 94 is energized while solenoids 82 and 84 remain de-energized. Solenoid 94 will energize to open and allow the flow from conduit 86 to connect to conduit 96 and thus provide fluid flow into port 16. Pressurized fluid into port 16 acts against first piston 26 to move along stationary tubular member 20 until piston 26 encounters the bumper 28 on mid-position extension stop means 24. The movement of the first piston 26 also moves its associated rod 42. The shoulder 48 on the first rod 42 moves the second piston 56 with the movement of the first piston 26.

To fully extend the three position cylinder, solenoid 82 is also energized in addition to solenoid 94. Energizing solenoid 82 shifts valve 80 to connect conduit 86 with conduit 88. With these fluid connections established, the fluid source supplies fluid under pressure through conduit 86 to conduit 88 and hence to port 18 of the three position cylinder. Pressurized fluid enters port 18 and flows through the passageways within tubular member 20 and first rod 42 to act against the closed end 66 of second rod 64. In addition, a portion of the pressurized fluid passes through aperture 52 and into the second Chamber 32. Therefore, the pressurized fluid also acts against the face 58 of the second piston 56. The fluid pressure against both the closed end 66 and face 58 facilitates moving the second rod 64 along with the second piston 56 in the extending direction. The piston 56 and rod 64 are fully extended when piston 56 encounters the head end 14 of the outer cylinder 10. The three position cylinder in its fully extended position is shown in FIG. 4.

To then retract the three position cylinder to its mid-position from its fully extended position, solenoid 94 remains energized and solenoid 84 will also be energized. Energizing solenoid 84 will shift valve 80 to connect conduit 86 with conduit 90. Pressurized fluid entering conduit 90 will thereby enter port 68 of the three position cylinder. Pressurized air entering port 68 will expand the fourth chamber 62 and move the second piston 56 toward the first piston 26. As the fourth chamber 62 expands, the second chamber 32 will contract. Open port 52 equalizes the second and third chambers 32 and 54, respectively, to allow fluid from the second chamber 32 to return back through port 18 and to atmosphere through valve 82 and a muffler 99. When retracting to the mid-position, solenoid 94 remains on. When the three position cylinder is to be fully retracted, both solenoids 94 and 82 are de-energized while solenoid 84 remains energized. Once the three position cylinder is fully retracted, the three position cylinder is ready to repeat the aforementioned cycle.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A three position cylinder assembly for movement between a fully retracted position, a midposition and a fully extended position, said cylinder assembly comprising of:

an outer cylinder connected between two bases, the first base defining a cap end and the second base defining a head end;

a first piston connect to a first rod;

a second piston connected to a second rod, wherein said first and second pistons are disposed and have reciprocal movement within the outer cylinder, said first and second rods extendable beyond the head end; and a stop means disposed in the outer cylinder for the first piston, wherein said stop means is spaced from said cap end and said head end.

2. The three position cylinder assembly of claim 1 further comprising a stationary tubular member having one end connected to the cap end of the outer cylinder and having the stop means disposed on the other end, said first piston having reciprocal movement along the tubular member.

3. The three position cylinder assembly of claim 2 wherein said first piston forms a first fluid chamber on one side of said first piston and a second fluid chamber on said other side of said first piston, wherein said tubular member is open to a port at one end and has a center passageway therethrough, providing a passageway opening to a third chamber.

4. The three position cylinder assembly of claim 3, further comprising a second port selectively opened to the first fluid chamber.

5. The three position cylinder assembly of claim 4, wherein said second piston has reciprocal movement along the first rod and forms a fourth fluid chamber on one side of said second piston and the second fluid chamber on said other side of said first piston.

6. The three position cylinder assembly of claim 5, further comprising a third port selectively opened to the fourth chamber.

7. The three position cylinder assembly of claim 6, further comprising an open access passageway between the second and third chambers.

8. The three position cylinder assembly of claim 7, further comprising:

first valve means for selectively communicating a fluid source to the first chamber;

second valve means for selectively communicating a fluid source to the second and fourth chambers; and third valve means for selectively communicating a fluid source to the third chamber.

9. The three position cylinder assembly of claim 1 wherein, said first rod has an open end distal from the first piston and an expanded collar connected to the first piston.

10. The three position cylinder assembly of claim 9, wherein said second piston has reciprocal movement along the first rod.

11. The three position cylinder assembly of claim 1, wherein said second rod has a closed end distal from the second piston.

12. A three position cylinder assembly for reciprocal movement between a fully retracted position, a midposition, and a fully extended position, said cylinder assembly comprising:

an outer cylinder housing having a pair of end walls and a pair of movable concentric cylinder rods, one of said end walls having an aperture for slidingly receiving said cylinder rods therethrough, each cylinder rod having a piston connected thereto at one end;

a stop means positioned within the outer cylinder housing, wherein aid stop means is spaced from said pair of end walls, and wherein a first piston is movable between one of the end walls and the stop means and a second piston movable between the first piston and the other end wall.

13. The three position cylinder assembly of claim 12 further comprising means for moving the pair of pistons together and means for moving each of pistons independently.

14. The three position cylinder assembly of claim 13, wherein the stop means is positioned on one end of a hollow tubular member fixedly attached to one end wall of the outer cylinder housing, said one end wall having a fluid access port therethrough and communicating with said hollow tubular member for expanding one of the cylinder rods and moving the piston connected thereto.

15. The three position cylinder assembly of claim 14, wherein the other cylinder rod and the piston connected thereto has reciprocal movement along the hollow tubular member.

* * * * *